United States Patent [19]

Crise

[11] 4,017,938

[45] Apr. 19, 1977

[54] CLEANER USING INTERMITTENT JETS OF FLUID SUPPLIED AT ABOVE AMBIENT PRESSURE

[76] Inventor: W. Paul Crise, 4921 NE. 2nd Ave., Pompano Beach, Fla. 33064

[22] Filed: July 24, 1975

[21] Appl. No.: 598,811

Related U.S. Application Data

[63] Continuation-in-part of Ser. No. 210,914, Dec. 22, 1971, abandoned.

[52] U.S. Cl. ..... 15/346; 15/404

[51] Int. Cl.[2] ..... A47L 5/14

[58] Field of Search ..... 15/345, 346, 404, 405, 15/421

[56] References Cited

UNITED STATES PATENTS

| | | | |
|---|---|---|---|
| 2,864,119 | 12/1958 | Crise | 15/345 X |
| 3,107,386 | 10/1963 | Mandin | 15/345 X |
| 3,268,942 | 8/1966 | Rossnan | 15/346 |

*Primary Examiner*—Christopher K. Moore

[57] ABSTRACT

This disclosure shows the supplying of fluid at a pressure greater than the pressure of the surrounding atmosphere to a cleaner in which the cleaning is done by intermittently and consecutively jetting fluid against the surface of the material being cleaned, where the total average pressure of the air or gas is maintained a few inches of water below the pressure of the surrounding atmosphere.

6 Claims, 3 Drawing Figures

CLEANER USING INTERMITTENT JETS OF FLUID SUPPLIED AT ABOVE AMBIENT PRESSURE

PRIOR RELATED APPLICATION

This is a continuation in part of my prior patent application Ser. No. 210,914 filed 12-22-71, now abandoned.

BACKGROUND OF THE INVENTION

The cleaner disclosed in this invention makes use of much that was disclosed in U.S. Pat. No. 2,864,119. This patent was issued to me on Dec. 16, 1958.

The cleaner disclosed in the above mentioned patent depends on the difference between the pressure of the air in the surrounding atmosphere and the pressure of the air in the cleaning tool immediately above the material being cleaned to supply the pressure required to cause the rotor in the distributing valve to rotate at desired speed and to produce the required velocity of air flow through the nozzle passages. On a short pile material this cleaner does a good job of cleaning but is hard to move over the material since a high vacuum in the cleaning tool holds it tightly to the material being cleaned. On a long pile material, such as a long pile carpet, so much air flows through the material under the cleaning tool to the space inside it that no substantial vacuum can be established over the material being cleaned and the cleaner is useless.

SUMMARY

In this invention, a pressure pump is interposed between the air surrounding the cleaning tool and the air distributing valve. This pump is adapted to supply air at sufficient pressure and volume to the intake manifold, which supplies air to the air distributing valve so that the valve rotor will rotate at the desired speed and air will flow intermittently and consecutively through the nozzle passages at the desired velocity, while the pressure in the cleaning tool immediately above the material being cleaned is slightly below the pressure of the surrounding atmosphere. The exhaust pump is required to exhaust air from space, 30, with such volume as to maintain sufficient vacuum in space 30 to prevent the escape of air from this space to the air outside of the cleaning tool and at the same time to deliver the dirt laden air to a suitable dirt collector.

As will be explained later, by making some changes in the embodiment of the invention as shown in the drawing, the pressure pump may be eliminated and the cleaner operated by the exhaust pump operating as both an exhaust pump and as a pressure pump.

The object of this invention is not only to overcome the problems found in the vacuum cleaner of U.S. Pat. No. 2,864,119, but to produce a cleaner that, while requiring a relatively small amount of power and almost no maintenance, even when used in heavy commercial service, is easily capable of producing violence of agitation and velocity of air jets beyond that required or even desired for thorough cleaning of all types of material.

Further objects and advantages will become more apparent from the following description and explanation, reference being made to the accompaning drawing, wherein an embodiment of the invention is illustrated.

DESCRIPTION OF THE PREFERRED EMBODIMENT

Figure 2:
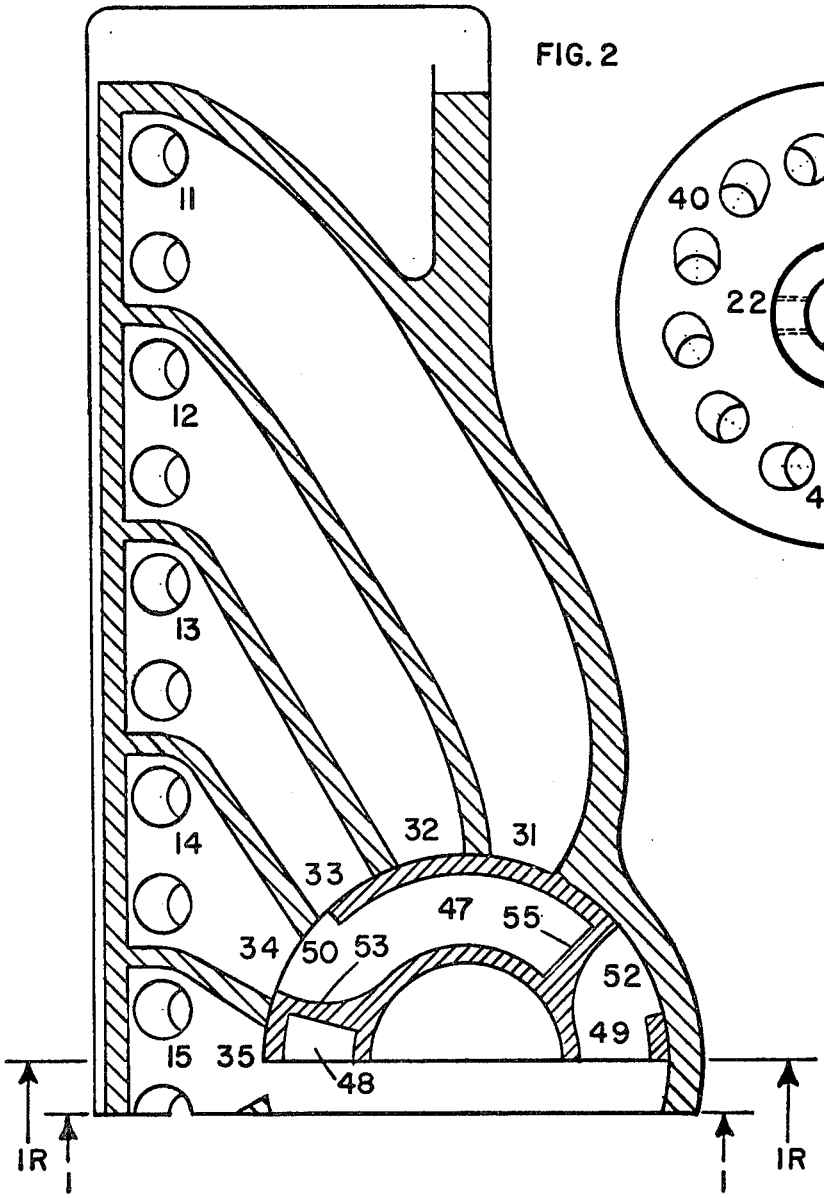
FIG. 2 is a top plan view in section, the section being taken along line 2—2 of FIG. 1.

1 is a molded or die cast member having an open bottom circular valve rotor cavity 20. As shown in FIG. 2, nine equally spaced open bottom passages, 31 through 39, extend outward from 20 and terminate in an equally spaced straight line to the left of valve stator cavity 20. It is to be noted that these passages vary in width in substantially the same ratio as they vary in length. As passages 31, 32, 33, and 37, 38, 39 leave the valve chamber, they gradually increase in width until they reach the desired width, at a slow enough rate to prevent turbulent flow. Passages 34, 35, and 36 increase in width too rapidly and turbulent flow through them will take place. As is shown in FIG. 2, the inner ends of these passages occupy 240 ° of the circumference of circular cavity 20. The other 120 ° of the circumference of cavity 20 is an unbroken circular wall.

Figure 1:
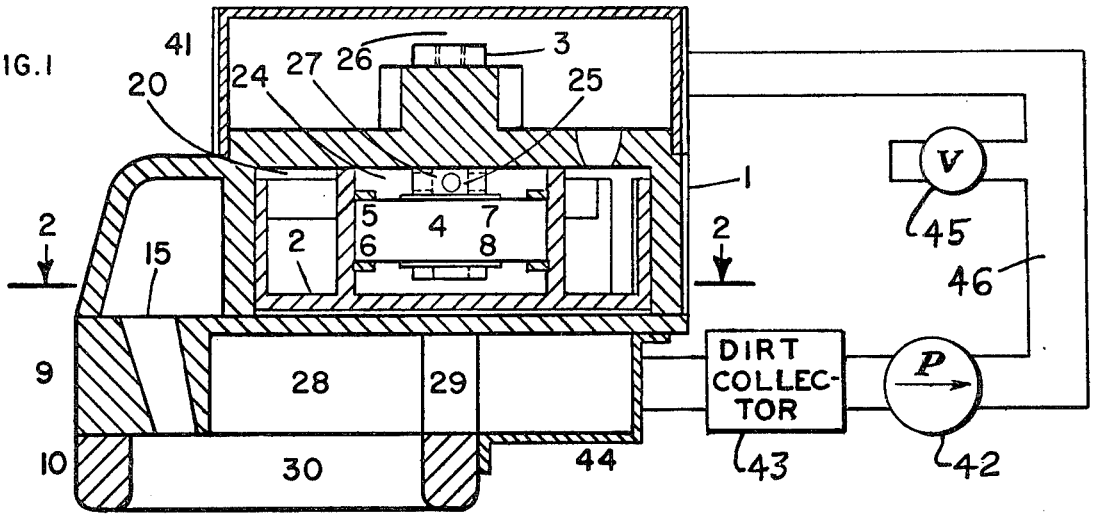
FIG. 1 is a side view in section, the section being taken along line 1—1 of FIG. 2, except the section of valve rotor 2 is taken along line 1R—1r of FIG. 2.
Figure 3:
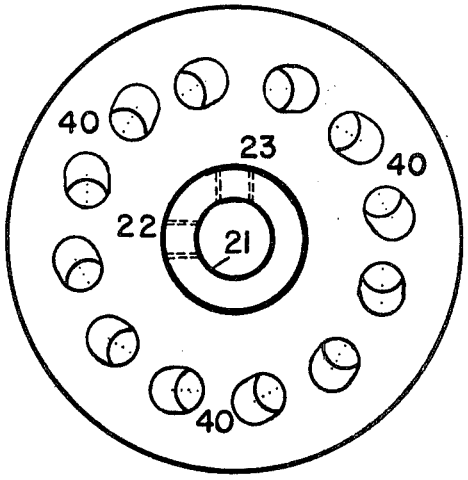
FIG. 3 is a top view of the circular entrance 20 and shaft support portion of 1.

As shown in FIGS. 1 and 3, the circular entrance and shaft supporting portion of 1 has a small circular projection extending upward from the main body. From the top of this projection, circular bore 21 extends downward to circular cavity 20 and is concentric with it. The diameter of this bore is similar to the diameter of the inner race of ball bearing 4. As is shown in FIG. 3, holes 22 and 23 are tapped to fit set screws. As shown in FIG. 3, 1 has 12 holes, 40 of about the same diameter as the diameter of the lower end of the eighteen twin nozzle passages, 11 through 19. These holes are spaced in a circle and extend downward at an angle of about 35 ° from the vertical leading counter-clockwise as they extend downward. Holes, 40, as shown in the drawing, are the same diameter at both ends. They may be substantially larger at their upper ends to simplify casting or molding if desired.

As shown in FIGS. 1 and 2, valve rotor 2 is a molded or die cast cup-shaped member having two circular walls. The outside diameter of the outer wall is about 1/64 of an inch less than the inside diameter of the valve rotor cavity 20. The overall height of 2 is about 1/32 of an inch less than the depth of cavity 20. The height of the outer wall of 2 is about 1.32 of an inch more than the height of its inner wall.

The inside diameter of cavity 24 is such that the outer race of ball bearing 4 can slide easily but snugly into it. This inside diameter has two shallow grooves cut into it, so located that retaining rings 5 and 6 can fasten the outer race of 4 in about the center of the inner wall of 2.

As shown in FIG. 2, the space between the wall surrounding space 24 and the outer wall of rotor 2 is divided into three similar sections- 47, 48 and 49, by three radial walls- 53, 54 and 55. As shown in FIG. 1, these three radial walls are about ⅔ as high as the outer circular wall of 2. As shown in FIG. 2, the outer circular wall of 2 is interrupted by three equally spaced vertical openings- 50, 51 and 52.

As described on Page 4, Lines 12–18, the 12 holes in 1 lead in a counter clockwise direction as they extend downward with air under pressure flowing from a pressure pump into intake manifold 41, and as shown in FIG. 1 flowing downward in a counter clockwise direction into the space between the inner and outer walls of rotor 2. This rotating air flow impinges against radial walls 53, 54 and 55 of rotor 2 and exerts force to cause rotor 2 to rotate in a counter clockwise direction. The volume of air flowing through rotor 2 is almost constant, as is the speed at which the rotor rotates.

As shown in FIG. 1, shaft 3 has an outside diameter that fits easily but snugly into bore 21 of 1 and into the inner race of ball bearing 4. Shaft 3 has a hole 27 through its center. The diameter of this hole, except for its top end, is about ½ the diameter of shaft 3. The upper end of hole 27 is smaller and is tapped at 26 to fit a set screw. Two shallow grooves are cut in the outer surface of shaft 3 to accommodate retaining rings and are so placed that rings 7 and 8 can fasten ball bearing 4 in a position about 3/32 of an inch above the end of shaft 3. Four holes, 25, are drilled through shaft 3 into hole 27 and are so placed as to be located between ball bearing 4 and the top of cavity 20. Shaft 3 should be positioned in hole 21 so that the circular wall surrounding space 24 just fully clears the top of cavity 20.

As shown in FIG. 1, fluid flow means, 9 has a flat top and is adapted to support 1 and to fit with it in a substantially air-tight manner. The top ends of the 18 round nozzle passages, 11 through 19 in 9, are spaced and positioned to register with passages 31 through 39 in 1. As shown in FIG. 1, passages 11 through 19 are substantially larger at their top end and slant downward to the right at an angle of about 15 °. By making small changes in 1 and 9, holes 11–19 could be vertical permitting less complicated and expensive tools for casting or molding 9. 28 is an elongated cavity extending the full width of 9 and passage 29 is formed by a gap in the center of the right wall surrounding 28.

10 is an elongated member having an elongated generally rectangular opening, 30, through it, and makes contact with the material being cleaned and is adapted to be connected to 9 in an easily replaceable manner.

As shown in FIG. 1, intake manifold 41 is formed of sheet metal, is adapted to be connected to the intake portion of 1 in a substantially air-tight manner and to accept the discharge or pressure side of pump 42. Pump 42 may be considered a vacuum-pressure pump. Exhaust manifold 44 is formed of sheet metal, is adapted to be connected to 9 and 10 in a substantially air-tight manner and to connect to the vacuum side of the vacuum-pressure pump 42 through passage 29 and space 28 to space 30 in elongated rectangular member 10 immediately above the material being cleaned.

The specification drawing does not show a motor to drive pump 42. The dust collector or tank, screen or filter 43 is connected between the manifold 44 and the input to pump 42. A by-pass valve 45 is connected to conduit 46 for regulating the air flow and pressure into manifold 41 and the vacuum in space 30. This device also includes hose or hoses, supporting wheels, handle, or other well known parts. The parts not shown are not a part of the invention and have been omitted to simplify the disclosure.

EXPLANATORY COMMENTS

In the embodiment of the invention shown in the drawing, the discharge exits of the eighteen nozzle passages, 11 through 19, are 9/32 inches in diameter and are spaced on 11/16 inch centers. Pressure pump 42 should have capacity to supply about 55 cubic feet of air per minute at a pressure of about 50 inches of water vacuum in space 30 of 5 to 10 inches of water while exhausting about 60 cubic feet of air per minute.

With holes 40 as shown in FIG. 3, having a diameter of about member having an elongated generally rectangular opening, 30, through it, and of an inch, valve rotor 2 should rotate at about 3,000 rpm and air should discharge from each of the 18 nozzle passages, 11 through 19, intermittently and consecutively about 9,000 times per minute and strike the material being cleaned at peak speeds of 150 miles per hour. This amounts to a total of 162,000 jets of air at 150 miles per hour striking the material covered by the cleaning tool each minute.

In this method of cleaning, rapidly repeated jets of high speed air are effective in producing the agitation required to loosen surface litter and to strike with the force needed to break it loose. The high speed jets easily penetrate material having the longest pile and are effective in removing the deepest embedded dirt. The violence of agitation and speed of air jets can easily be reduced by providing an adjustable restriction 45, between the atmosphere and pressure pump 42 or between and intake manifold 41.

As shown in FIG. 1, valve rotor 2 is supported on shaft 3 by a single ball bearing. This bearing is a 12 millimeter double shielded light duty deep groove bearing and is produced by most major manufacturers. This bearing is easy to apply, is very lightly loaded and should have a life of hundreds of thousands of hours. After considerable use, by removing the screw from 26, a few drops of oil can be applied through hollow shaft 3 to the bottom of space 24 to prevent the grease in bearing 4 from drying out.

If used many hours daily in commercial use, 10 should be made of a long-wearing material. For domestic use, it could be of a single piece with 9.

As shown in FIG. 2, 32 and 31 are progressively wider than 33. At 3,000 revolutions per minute, the time available for the air jets to reach maximum speed is about 0.0015 seconds. The main resistance to this build up in speed is the inertia of the air between spaces 47, 48 and 49, and the outlets of nozzle passages 11 through 19. The inertia of the air in ducts 31 through 39 is the only variable in the rate in which are velocity will build in nozzle passages 11 through 19. I have discovered that if the cross sectional area of ducts are made to have similar ratios to their length, they will offer similar resistances to change of volume of flow through them. Applying this principle to passages 31 through 33 and 37 through 39, passages 11 through 13 and 17 through 19 will have about the same peak speeds of air through them. Passages 14 through 16 will have higher peak speeds but not by an objectionable amount.

As previously indicated, the embodiment of the invention as described in the specification may be adapted to operate without using an exhaust pump by making the following changes and adjustments: change the elongated rectangular member having a solid cross section, which surrounds 10, to a member having an inverted U-shaped cross section, the open end of the U adapted to contact the material being cleaned. Connect the closed end of the U-shaped section to intake manifold 41 by passages adjustable as to resistance to air flow. Remove exhaust pump 45 and connect exhaust manifold 44 directly to the litter collecting container. Place the cleaning tool on the material to be cleaned and start pressure pump 42. Adjust the resistance to air flow of the passages connecting the closed end of the U-shaped section of 10 to the intake manifold 41 until the pressure in the inverted U of 10 is substantially above the pressure in space 30.

The cleaner is now ready to use, the higher pressure in the inverted U-shaped space in 10 preventing any leaking of litter-laden air from escaping to the atmosphere. This adaptation of the invention, while requiring no vacuum, is limited to use on material having a narrow range of porosity without adjustment. On porous material, like long pull carpet, or where the litter-laden air is to be delivered at some distance, an exhaust pump would be desirable.

While the embodiment of the invention shown is a preferred form, it is to be understood that other forms, including that described immediately above, may be adapted falling within the scope of the claims that follow

I claim:

1. A cleaning tool for carpet or material comprising:

an elongated member having a substantially horizontal elongated opening, said member having a lower surface surrounding said opening for engaging the material being cleaned;

an elongated cavity permanently open to said elongated opening, said cavity having an outlet opening;

said elongated member having a plurality of nozzle passages for discharging gas against the material being cleaned, said nozzle passages positioned above the portion of said surface engaging the material and spaced longitudinally along the length of said elongated opening in said elongated member;

a circular valve rotor cavity connected through inlet passages to an intake manifold said circular valve rotor cavity having a plurality of connecting passages spaced around and leading away from said rotor cavity, each passage connecting separately to at least one of said nozzle passages for discharging jets of gas against the material being cleaned the cross-section of each connecting passage gradually increasing from cavity to nozzle passage;

a rotatable valve member positioned in said circular valve rotor cavity, rotatable by gas flowing through said circular valve rotor cavity, said rotatable valve member having openings in the sides thereof which, during rotation, consecutively align with each connecting passage allowing said gas to pass therethrough to separately and consecutively connect said cavity to said nozzle passages, said connecting passages between said valve chamber and said nozzle passages being so proportioned that the peak velocity of the jets of gas flowing through each nozzle passage is substantially the same for all of said nozzle passages;

an intake manifold secured to said rotor cavity having inlet passages connecting said manifold to said rotor cavity;

at least one gas pump having a pressure side connected to said intake manifold and adapted to supply gas to the intake manifold at sufficient pressure and volume to cause said rotatable valve member to rotate and to deliver rapidly repeated high speed jets of gas of a desired velocity through said nozzle passages to impinge upon said material, said elongated cavity outlet opening connected to the intake side of a pump and adapted to maintain a lower pressure of the gas adjacent where the jets strike the material being cleaned;

a dirt collector connected between said cavity outlet and said intake side of said pump, and a pressure release means, between the pressure side of said pump and said intake manifold, for regulating the gas pressure forced into said intake manifold.

2. A cleaning tool for carpet or material comprising, an elongated member having a horizontal elongated opening therein, said member having a lower portion, bordering said opening,for engaging the surface of the material being cleaned;

an elongated cavity, permanently open to said elongated opening, said cavity having an outlet opening;

a pluraity of nozzle passages connected to said elongated member for discharging gas against the material being cleaned, said nozzle passages positioned above said elongated opening of said member and spaced along the length of said elongated opening;

a circular valve rotor cavity having an inlet passage, and a plurality of evenly spaced connecting passages leading from said cylindrical valve chamber to one or more of said nozzle passages, said connecting passages having gradually increasing cross-sections from said rotor cavity each passage having the areas of its cross-sections vary substantially in proportion to its length;

a rotatable valve member, rotatably mounted in said circular valve rotor cavity, rotatable by gas flowing through said circular valve rotor cavity said rotatable valve member having openings in the sides thereof which, during gas-flow-induced rotation, consecutively align with each of said connecting passages allowing said gas to pass from said valve member into said interconnecting passages to connect separately and consecutively each said nozzle passage with the incoming gas;

a gas pump, the exhaust side of which is sealingly connected to said inlet passage and adapted to supply gas to the said inlet passage to cause the nozzle passages to deliver rapidly repeated high speed jets of gas against the material to be cleaned;

said outlet opening being connected to the intake side of said pump and adapted to maintain a low pressure within said elongated member adjacent the material being cleaned in order to withdraw the loosened dirt and the gas leaking into said member from about said lower portion; and a dirt collector positioned between the intake side of said pump and said outlet opening.

3. A cleaning tool as set forth in claim 1 wherein said cleaning tool includes only one pump.

4. A cleaning tool for carpet or material, comprising:

an elongated member connected throughout its length with a normally substantially horizontal elongated opening, adapted to engage the surface of the material being cleaned;

an elongated cavity, permanently open to the opening, and ending as an outlet opening, elongated member having a plurality of nozzle passages for discharging gas against the material being cleaned, positioned above where the elongated rectangular opening engages the surface of the material, and spaced longitudinally along the length of said member;

a cylindrical valve rotor cavity, connected through inlet passages to an intake manifold, and having a plurality of passages spaced around the circumference of said rotor cavity, and leading away from it, each passage connecting separately to one or more of the nozzle passages for discharging jets of gas against the material being cleaned; the passages leading from the cylindrical valve rotor cavity to the nozzle passages being so proportioned that the areas of their cross sections vary substantially in proportion to their length, the areas of their cross sections increasing gradually as the passages leave the valve rotor cavity, until the areas of their cross sections reach the desired values;

a rotatable valve member positioned in said valve rotor cavity, adapted to be rotated by gas flowing through it, and adapted, when rotated, to connect the intake manifold of said valve rotor cavity separately and consecutively to the aforesaid nozzle passages;

the intake manifold being connected to a pressure pump, adapted to supply gas to the intake manifold at sufficient pressure and volume to cause the rotatable valve member to rotate at the desired speed and the nozzle passages to deliver their rapidly repeated high speed jets of gas at the desired velocity, while the pressure of the gas in the cleaning tool, above where the jets of gas strike the material being cleaned, is a few inches of water below the pressure of the atmosphere outside of the cleaning tool; the outlet opening of the cleaning tool being connected to an exhaust pump, adapted to maintain the pressure of the gas in the cleaning tool, above where the jets of gas strike the material being cleaned, at the afore mentioned pressure, while exhausting the gas discharged by the nozzle passages plus discharged by the nozzle passages plus the loosened dirt and the air leaking into the cleaning tool, and delivering the dirt laden gas to a suitable dirt collector;

the passages leading from the valve chamber to the nozzle passages being, so proportioned that the peak rate of flow, is substantially the same for all of the jet passages.

5. A cleaning tool as set forth in claim 2 further comprising a pressure release means between said pump and said inlet passage.

6. A cleaning tool for carpet and the like comprising:

an elongated member having a normally substantially horizontal elongated opening therethrough, the lower portion of which member comprises means for engaging the surface of the material being cleaned;

a fluid flow means, superimposed upon, and sealingly secured to, said rectangular member, said flow means having a plurality of nozzle passages therethrough communicating with said opening and having an elongated cavity therethrough communicating with said opening at a site remote from the point of entry of said nozzle passage, said elongated cavity having an exhaust opening therein adapted to be sealingly connected to a means for evacuating gas;

a member, superimposed upon, and sealingly secured to, said fluid flow means, said member having a circular valve rotor cavity interiorly thereof, having a plurality of passages individually intersecting said rotor cavity about the circumference thereof and connecting said rotor cavity with discrete groups of said nozzle passages, and having a plurality of holes in the top of said member communicating with said cavity and disposed radially about the axis thereof, said holes being uniformly tilted from the vertical;

mounting means attached to said member interiorly of said circular valve rotor cavity;

a circular valve rotor adapted to fit into said circular valve rotor cavity and rotatably mounted upon said mounting means, said valve rotor having a solid bottom, an outer wall, having a plurality of openings therein of a size and shape similar to the passage intersections, an inner wall, and a number of radial walls equal to the number of openings in said outer wall and connecting said inner wall with said outer wall and connecting said inner wall with said outer wall and connecting said inner wall with said outer wall immediately adjacent one side of each of said openings;

an intake manifold superimposed upon, and sealingly secured to, said member, having an opening therein adapted to be sealingly connected to a source or pressurized gas and having a second opening therein communicating with said holes in said member, a gas pump having the exhaust side thereof sealingly connected to said opening of said intake manifold and the intake side thereof sealingly connected to said exhaust opening of said fluid flow means, a pressure release means connected between said exhaust side of said pump and said intake manifold, so constructed and arranged that pressurized gas supplied to the intake manifold will be forced generally downward through the tilted holes in the member and into the circular valve rotor cavity where the tilted gas streams will impinge upon the radial walls of the rotor causing the rotor to rotate about the mounting means, sequentially matching the openings in the outer wall of the rotor with individual passages of the member and allowing the gas to sequentially pass through the passages, to the nozzle passages associated therewith and therethrough, to impinge upon the portion of the material enclosed by the elongated rectangular opening of the elongated rectangular member and to, thereafter, be exhausted through the elongated cavity.

* * * * *